US005207931A

United States Patent [19]

Porter

[11] Patent Number: 5,207,931

[45] Date of Patent: May 4, 1993

[54] BRACE FOR CONCRETE FORM

[76] Inventor: Walter W. Porter, 1500 Palo Verde Dr., Carson City, Nev. 89701

[21] Appl. No.: 835,692

[22] Filed: Feb. 12, 1992

[51] Int. Cl.[5] ..... E04G 17/14

[52] U.S. Cl. ..... 249/210; 249/34; 249/40; 249/213; 249/219.1

[58] Field of Search ..... 249/2-8, 249/34, 40, 210, 213, 216, 219.1, 219.2; 248/351, 354.1, 357

[56] References Cited

U.S. PATENT DOCUMENTS

| | | | |
|---|---|---|---|
| 1,644,586 | 10/1927 | Heltzel | 249/5 |
| 2,251,775 | 8/1941 | Arrighini | 249/34 |
| 2,289,819 | 7/1942 | Wirtane | 249/34 |
| 2,298,837 | 10/1942 | Oswald | 249/34 |
| 2,387,445 | 10/1945 | Herring | 249/34 |
| 2,490,228 | 12/1949 | Pontiere | 249/22 |
| 2,511,829 | 6/1950 | Arrighini et al. | 249/175 |
| 2,685,724 | 8/1954 | Peterson | 249/34 |
| 2,973,567 | 3/1961 | Brow, Jr. et al. | 249/34 |
| 3,195,852 | 7/1965 | Lundell | 249/34 |
| 3,405,905 | 10/1968 | Dakin | 249/40 |
| 3,722,849 | 3/1973 | Luyben | 249/219.1 |
| 3,778,020 | 12/1973 | Burrows et al. | 249/219.1 |
| 4,723,752 | 2/1988 | Thomas | 249/219.1 |
| 5,076,535 | 12/1991 | Vetter | 249/219.1 |

*Primary Examiner*—Jay H. Woo
*Assistant Examiner*—James P. Mackey
*Attorney, Agent, or Firm*—John E. Roethel

[57] ABSTRACT

A concrete brace has a lower brace leg including a lower bracing section and a lower support section, an upper brace leg including an upper bracing section and an upper support section, and a brace cross support joining the upper end of the lower brace leg to the lower end of the upper brace leg. The lower end of the upper brace leg has a strap mounting flange provided thereon to which is connected one end of a first cross strap. The upper end of the upper brace leg has a strap attachment cap to which is also mounted one end of a second cross strap. By using a set of two concrete braces positioned on either side of a set of wooden frames, with the concrete braces joined together by the cross straps, a foundation having an integral base portion and wall portion can be formed in a single pour of concrete. A plurality of these sets of two concrete braces can be positioned at appropriate locations along the length of the wooden frame laid out to shape the concrete to be poured as the foundation of a building.

9 Claims, 4 Drawing Sheets

BRACE FOR CONCRETE FORM

This invention relates to a brace for a concrete form, and more particularly to a brace comprising a unitary member having a lower footing bracing element and an upper wall bracing element and adaptable to be connected to a similar brace on the opposite side of the form by means of cross straps.

BACKGROUND OF THE INVENTION

In the construction of buildings, it is conventional to provide the foundation or footings in an inverted T-shape comprising a footing base and an upstanding sidewall. The foundation is laid out is the desired pattern to provide the needed support for the remainder of the building. Typically, the layout of the foundation conforms to the general outline of the outer walls of the building. The footing base is designed to lie under the level of the ground and building's upstanding side walls are mounted onto the footing base.

Typically, both the footing base and the upstanding sidewalls are formed of concrete. In order to comply with load-bearing requirements imposed by engineering principles and municipal regulations, the footing base is typically much wider than the thickness of the upstanding sidewalls.

It has been conventional practice to first pour the footing base to the desired width and allow the footing base to cure. The framing for the upstanding sidewalls is then configured around the footing base and concrete is poured into the framing to form the upstanding sidewalls to the desired height and thickness. Because the upstanding sidewalls are not formed at the same time as the footing base, it is conventional to utilize reinforcing rods that are embedded in the footing base when the footing base is poured and extend upwardly therefrom. The concrete forming the upstanding sidewalls then sets up and encompasses the reinforcing rods and secures the upstanding sidewalls to the footing base.

There have been many proposals to pour the footing base and the upstanding sidewalls in a single pour to effect an integral foundation and thus eliminate the need for reinforcing rods. As discussed in U.S. Pat. No. 2,685,724 (Peterson), the footing base is shaped by a pair of parallel spaced panels which rest on edge on the ground and are spaced apart the width of the desired footing base. The upstanding walls are formed by a similar pair of parallel spaced panels positioned inwardly and above the footing base panels since the upstanding wall is typically more narrow than the footing base. The relative positions of the footing base panels and the upstanding wall panels are maintained by a "jury structure" that is typically expensive and time-consuming to install. The jury structure is generally formed of wood and nails.

The Peterson patent describes a holding frame that is used to maintain the relative positions of the footing base panels and the upstanding wall panels. This configuration joins the left side and right side braces by means of a holding frame that includes a pivoted connection. The Peterson configuration nevertheless suffers from the drawback of having the braces permanently interconnected by the holding frame. If the holding frame is assembled off of the job site, then the exact dimensions and parameters of the foundation must be predetermined. If the holding frame is assembled at the job site, then the attachment of the holding frame may be a tedious and time-consuming operation.

U.S. Pat. No. 3,195,852 to Lundell shows another apparatus that is proposed for forming the footing base and the upstanding sidewalls in a single pour. The base of the foundation is formed by digging a hole in the ground at the location where the base is to be poured. Arranged above the hold are a pair of wall forming frame sections which are supported laterally by vertically rising brace members. The tops of the brace members are connected by strap elements. Lundell provides a leveling arrangement utilizing cranks to accommodate height variations in the level of the ground on each side of the hole dug to receive the base of the foundation.

Lundell does not provide a system that can be used if wooden frames are desired to shape both the base portion and the wall portion of the foundation. The crank arrangement increases the complexity of the work required in the field and complicates what should otherwise be a straightforward and simple operation. Lundell's apparatus necessitates the use of more highly skilled employees than would be required by the use of the present invention.

It is an object of the present invention to provide a concrete brace that can be used to integrally join the footing base to the upstanding sidewalls in a single pour.

It is a feature of the present invention to provide a concrete brace made of angle iron in a generally L-shaped configuration. The brace is used in combination with a like brace oriented in a mirror image to the first brace and connected by means of a cross strap.

It is an advantage of the present invention that the concrete brace is easily connected to the wooden frames that will shape the concrete on the job site.

SUMMARY OF THE INVENTION

A concrete brace has a lower brace leg including a lower bracing section and a lower support section, an upper brace leg including an upper bracing section and an upper support section, and a brace cross support joining the upper end of the lower brace leg to the lower end of the upper brace leg. The lower end of the upper brace leg has a strap mounting flange provided thereon to which is connected one end of a first cross strap. The upper end of the upper brace leg has a strap attachment cap to which is also mounted one end of a second cross strap. By using a set of two concrete braces positioned on either side of a set of wooden frames, with the concrete braces joined together by the cross straps, a foundation having an integral base portion and wall portion can be formed in a single pour of concrete. A plurality of these sets of two concrete braces can be positioned at appropriate locations along the length of the wooden frame laid out to shape the concrete to be poured as the foundation of a building.

DETAILED DESCRIPTION OF THE PREFERRED EMBODIMENTS

Figure 1:
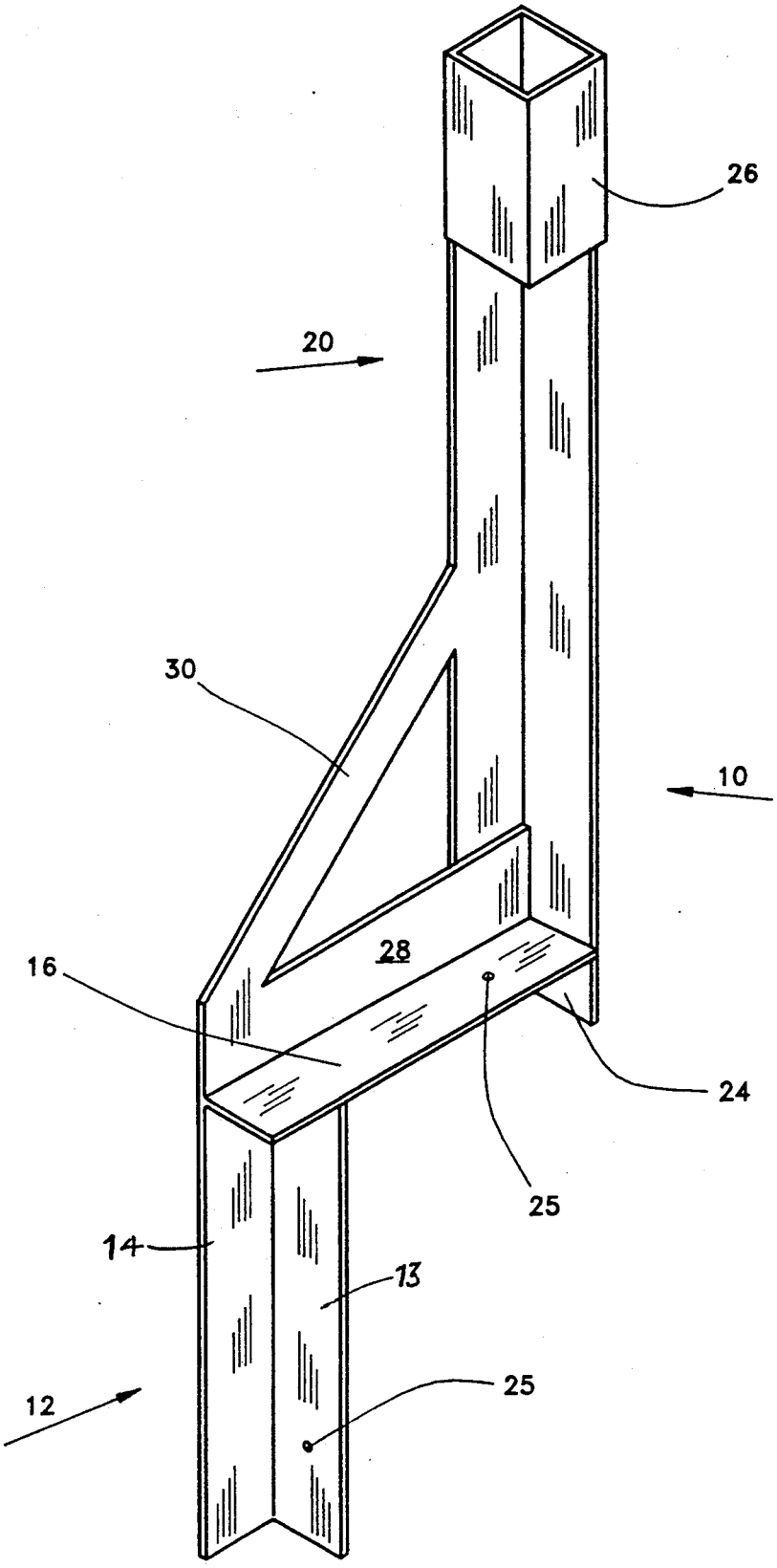
FIG. 1 shows a perspective view of the concrete brace of the present invention.

The concrete brace of the present invention is shown generally at 10 in FIG. 1. The concrete brace 10 is preferably constructed from steel, iron, aluminum or other metal material and comprises a lower brace leg 12 which is configured to rest against the back side of a wooden frame that will form the base portion of the foundation and a upper brace leg 20 which is configured to rest against the back side of a wooden frame that will form the wall portion of the foundation.

The lower brace leg 12 has a lower bracing section 13 and a lower support section 14 oriented generally 90° to the lower bracing section 13. The height of the lower brace leg 12 is selected to conform to the height of the wooden frame for the base portion of the foundation.

At the upper end of the lower brace leg 12, there is provided a brace cross support 16 disposed horizontally. The brace cross support 16 is attached to the upper bracing section 21 of the upper brace leg 20. An upright support 28 is provided that also joins the lower brace leg 12 to the upper brace leg 20. The upright support 28 is disposed at a generally 90° angle to the brace cross support 16 and can be welded thereto or formed integrally with the brace cross support 16. Additional structural support is provided by an angled support 30 that is attached to the upright support 28 and the upper support section 22 on the upper brace leg 20.

The upper brace leg 20 has a upper bracing section 21 and a upper support section 22 oriented generally 90° to the upper bracing section 21. The lower end of the upper bracing section 21 is provided with a strap mounting flange 24 that interacts with an end flange of the cross strap 40 as will be explained herein. The upper end of the upper brace leg 20 is provided with a strap attachment cap 26 that receives a flange end of a cross strap 40 as will also be explained herein. The height of the upper brace leg 20 is selected to conform to the height of the wooden frame for the wall portion of the foundation.

Figure 2:
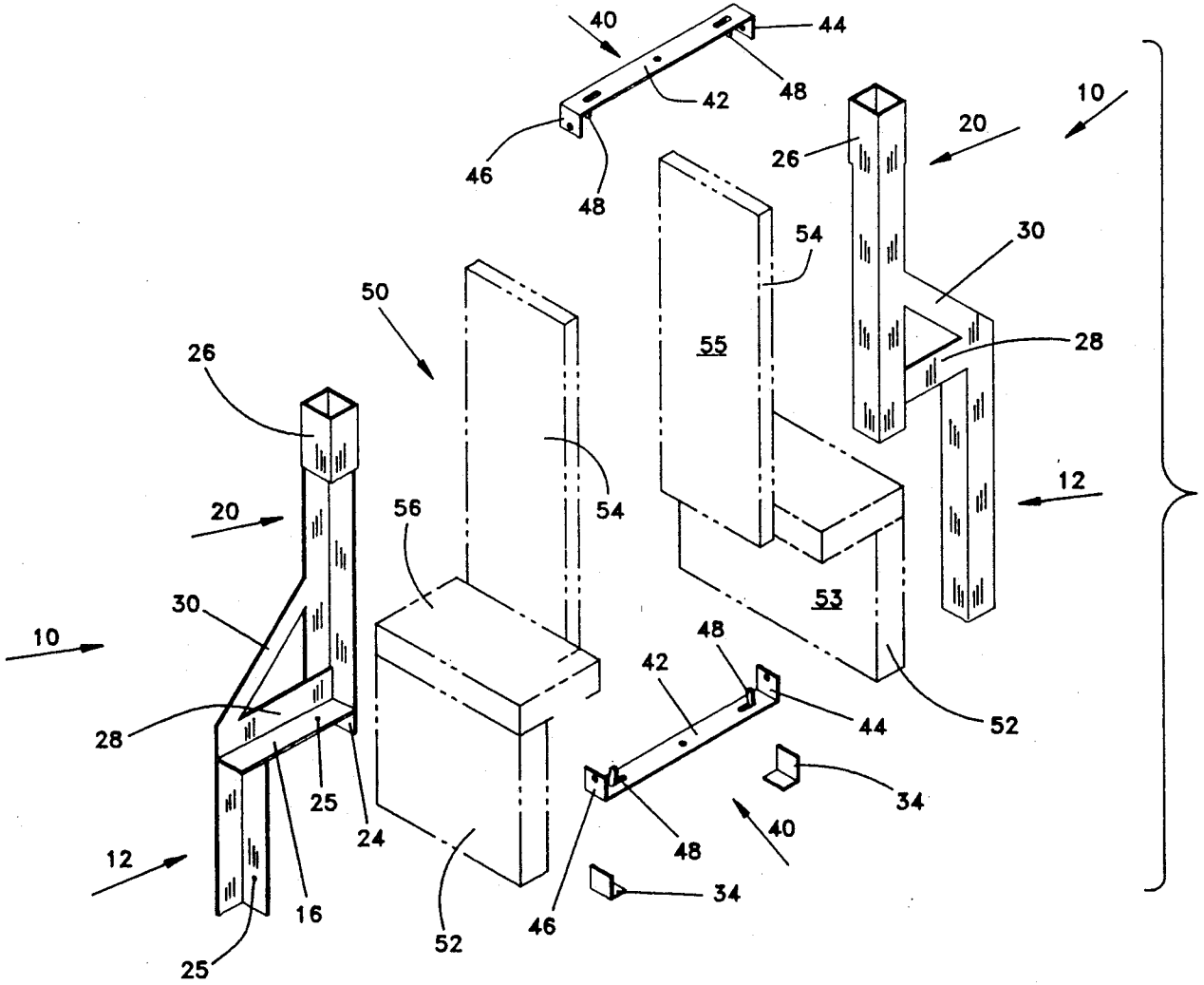
FIG. 2 shows a perspective exploded view of a pair of concrete braces of the present invention as well as the cross straps used to connect the concrete braces with the wooden concrete-shaping forms shown in phantom.

FIG. 2 shows an exploded view of the concrete brace 10 along with an identical concrete brace 10 oriented on opposite sides of a pair of wooden frames 50 as well as two cross straps 40 that combine to form the bracing assembly of the present invention. Each wooden frame 50 comprises a lower frame leg 52 that includes a flat lower inner surface 53 that shapes the outside boundary in the base portion of the foundation when the concrete is poured into the wooden frame 50. The wooden frame 50 also includes a upper frame leg 54 that includes a flat upper inner surface 55 that shapes the outside boundary in the wall portion of the foundation when the concrete is poured into the wooden frame 50. The lower frame leg 52 is connected to the upper frame leg 54 by a cross frame support 56. The interior surface of each of the cross frame supports 56 is provided with a metal L-shaped flange 34 that provides the lower support for the bottom of the cross strap 40. Two wooden frames 50 are used to form a solid concrete foundation.

A pair of cross straps 40 are shown in FIG. 2 which are used to secure the two concrete braces 10 together in a clamping configuration around the external sides of the wooden frames 50. Each cross strap 40 comprises a body member 42, a first end flange 44 and second end flange 46. Located adjacent each end flange on the cross strap 40 is a tongue 48 which is partially punched out of the cross strap 40.

Figure 3:
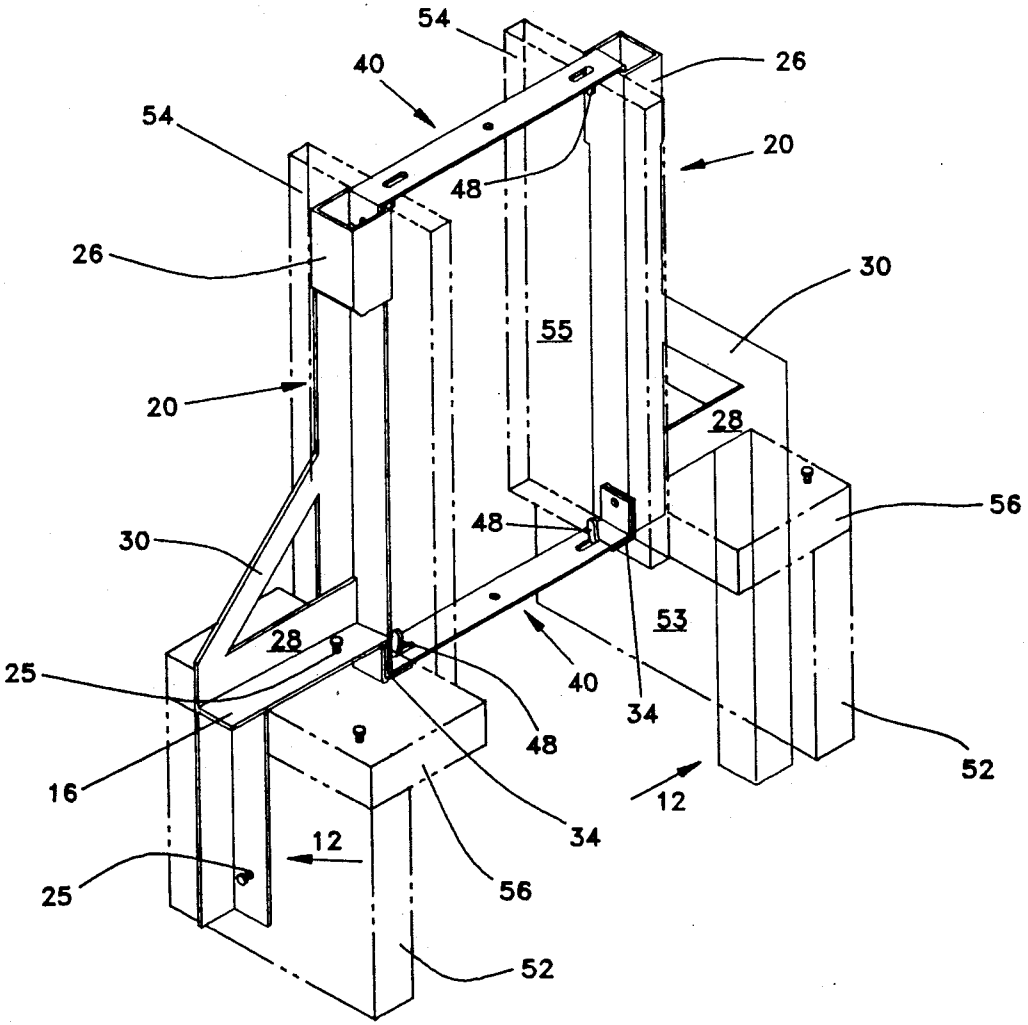
FIG. 3 shows a perspective assembled view of a pair of concrete braces of the present invention as well as the cross straps used to connect the concrete braces with the wooden concrete-shaping forms shown in phantom.

FIG. 3 shows the bracing assembly of the present invention mounted around a pair of wooden frames 50 and ready to receive a pour of concrete. Each concrete brace 10 is positioned around the external sides of a wooden frame 50 with the lower brace leg 12 abutting the lower frame leg 52, the underside of the brace cross support 16 abutting the cross frame support 56 and the upper brace leg 20 abutting the external side of the upper frame leg 54. Nails may be inserted through the nail apertures 25 in the various sections of the concrete brace 10 to fasten the concrete brace 10 to the wooden frame 50.

Also as shown in FIG. 3, each end flange 44, 46 of the lower cross strap 40 is hooked under the strap mounting flange 24 on the lower end of the upper brace leg 20. Each underside end of the cross support 40 rests in the L of the L-shaped flange 34. The upper frame leg 54 of each wooden frame 50 sits in the space between the tongue 48 and the upper bracing section 21.

Likewise, an upper cross strap 40 joins the tops of each of the concrete braces 10 with each end flange 44, 46 of the upper cross strap 40 hooking into the open portion of the strap attachment cap 26 at the upper end of the upper brace leg 20 on each concrete brace 10.

The bracing assembly of the present invention is easily assembled in the field. The wooden frame can be laid out to form the desired layout for the foundation. The bracing assembly can be positioned at appropriate locations along the lengths of the wooden frame, preferably every six feet or so. The concrete is poured and the base and wall of the foundation is formed integrally, thus eliminating the meed for reinforcing rods and the concern that the wall portion of the foundation may not bond to the base portion. After the concrete has hardened, it is a simple matter to disassemble the bracing assembly and remove the wooden frame sections. Both the wooden frame and the bracing assembly can be reused for a different pour. The lower cross strap is the only part of the bracing assembly that remains embedded in the poured concrete.

Figure 4:
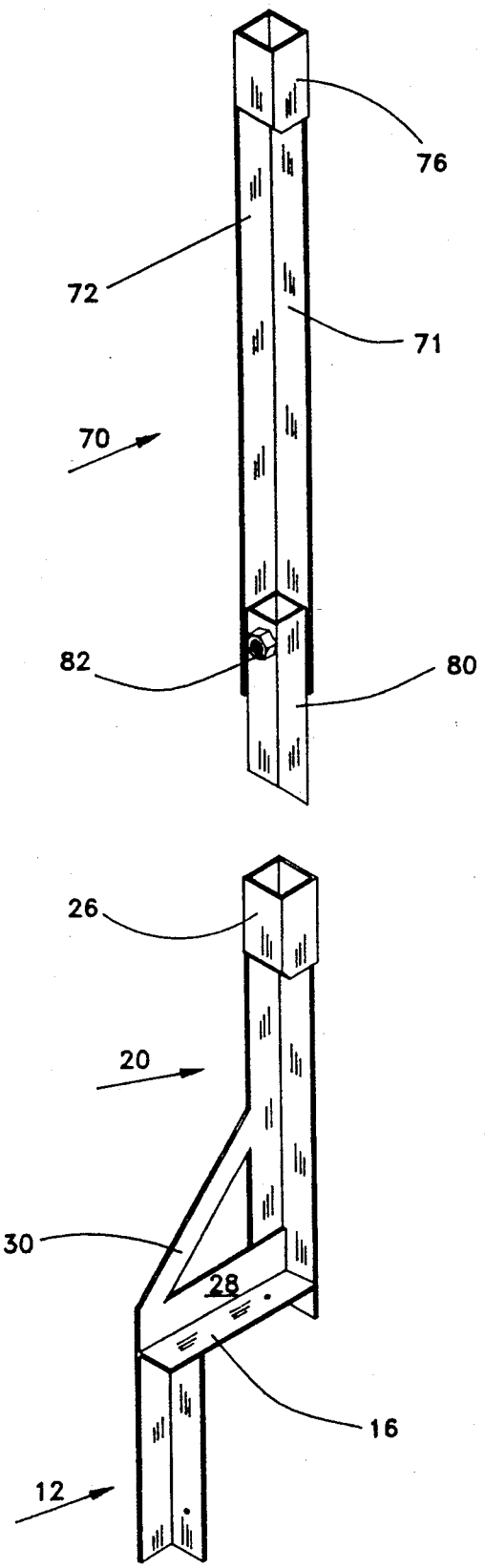
FIG. 4 shows a perspective view of the concrete brace of the present invention including the extension member to accommodate wall sections of extended height.

FIG. 4 shows a modification of the present invention in which a brace extension 70 can be added to the upper end of the upper brace leg 20 to accommodate wall portions of the foundations that are poured to an extended height. The brace extension 70 comprises an extension bracing section 71 that is designed to abut the external surface of the wooden frame that will form the upper portion of the extended height of the wall of the foundation. Disposed at a generally 90° angle to the extension bracing section 71 is an extension support section 72 that provides additional structural support. At the upper end of the extension bracing section 71 is an extension attachment cap 76 that will receive an end flange of a cross strap in the manner similar to that shown in FIG. 3.

The lower end of the brace extension 70 is provided with an extension leg 80 welded or otherwise attached thereto and sized to fit into the hollow interior of the strap attachment cap 26 on the upper end of the upper brace leg 20. A bolt stop 82 is attached to extension leg 80 to act as a stop and position the extension leg 80 in the interior of the strap attachment cap 26. The bolt stop 82 also provides a convenient location at which the extension leg 80 can be gripped by an appropriate tool to remove the extension leg 80 from the brace extension 70 when disassembly is required.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A concrete brace comprising:

a) a lower brace leg including a lower bracing section and a lower support section, b) an upper brace leg including an upper bracing section and an upper support section, c) a brace cross support joining the upper end of the lower brace leg to the lower end of the upper brace leg, d) the lower end of the upper brace leg having a strap mounting flange provided thereon, e) the upper end of the upper brace leg including a strap attachment cap, and f) an angled support joining the upper end of the lower brace leg to the upper brace leg.

2. The concrete brace of claim 1 further including at least one nail aperture provided in the lower brace leg so that the lower brace leg can be attached to a wooden frame section.

3. The concrete brace of claim 1 further including at least one nail aperture provided in the brace cross support so that the brace cross support can be attached to a wooden frame section.

4. The concrete brace of claim 1 further including a brace extension mounted into the strap attachment cap of the upper brace leg of the concrete brace so that the concrete brace can accommodate wooden frames of extended height.

5. The concrete brace of claim 4 wherein the brace extension comprises:

a) an extension bracing section, b) an extension support section, c) an extension attachment cap mounted at the upper end of the brace extension, d) an extension leg mounted at the lower end of the brace extension, and e) a bolt stop attached to the extension leg to position the location of the extension leg in the strap attachment cap of the upper brace leg of the concrete brace.

6. A concrete bracing assembly for bracing a wooden frame arranged to pour the base portion and wall portion of a foundation in a single pour comprising:

a) a first concrete brace comprising 1) a lower brace leg including a lower bracing section and a lower support section, 2) an upper brace leg including an upper bracing section and an upper support section, 3) a brace cross support joining the upper end of the lower brace leg to the lower end of the upper brace leg, 4) the lower end of the upper brace leg having a strap mounting flange provided thereon, 5) the upper end of the upper brace leg including a strap attachment cap, and 6) an angled support joining the upper end of the lower brace leg to the upper brace leg, b) a second concrete brace comprising 1) a lower brace leg including a lower bracing section and a lower support section, 2) an upper brace leg including an upper bracing section and an upper support section, 3) a brace cross support joining the upper end of the lower brace leg to the lower end of the upper brace leg, 4) the lower end of the upper brace leg having a strap mounting flange provided thereon, 5) the upper end of the upper brace leg including a strap attachment cap, and 6) an angled support joining the upper end of the lower brace leg to the upper brace leg, c) a first cross strap joining the strap attachment cap of the first concrete brace to the strap attachment cap of the second concrete brace, and d) a second cross strap joining the strap mounting flange of the first concrete brace to the strap mounting flange of the second concrete brace.

7. The concrete bracing assembly of claim 6 wherein each cross strap comprises:

a) a body member, b) a first end flange at one end of the body member, and c) a second end flange at the other end of the body member.

8. The concrete bracing assembly of claim 6 further including a brace extension mounted into the strap attachment cap of the upper brace leg of each of the concrete braces so that each concrete brace can accommodate wooden frames of extended height.

9. The concrete bracing assembly of claim 8 wherein the brace extension comprises:

a) an extension bracing section, b) an extension support section, c) an extension attachment cap mounted at the upper end of the brace extension, d) an extension leg mounted at the lower end of the brace extension, and e) a bolt stop attached to the extension leg to position the location of the extension leg in the strap attachment cap of the upper brace leg of each of the concrete braces.

* * * * *